United States Patent [19]

Van Vliet et al.

[11] 4,439,762

[45] Mar. 27, 1984

[54] GRAPHICS MEMORY EXPANSION SYSTEM

[75] Inventors: James G. Van Vliet, La Habra; Frank M. Aralis, Irvine, both of Calif.

[73] Assignee: Beckman Instruments, Inc., Fullerton, Calif.

[21] Appl. No.: 334,807

[22] Filed: Dec. 28, 1981

[51] Int. Cl.[3] ..... G09G 1/02

[52] U.S. Cl. ..... 340/750; 340/728; 340/735; 340/799

[58] Field of Search ..... 340/750, 798, 799, 735, 340/790, 728; 178/30

[56] References Cited

U.S. PATENT DOCUMENTS 3,546,681 12/1970 Korn et al. ..... 340/735

4,052,719 10/1977 Hutt et al. ..... 178/30

4,081,799 3/1978 Granberg et al. ..... 340/750

4,250,502 2/1981 Klauck et al. ..... 340/728

4,308,532 12/1981 Murphy ..... 340/750

*Primary Examiner*—Gerald L. Brigance

*Attorney, Agent, or Firm*—R. J. Steinmeyer; R. R. Meads; G. T. Hampson

[57] ABSTRACT

A video display memory expansion system for expanding the graphics memory within the video display. The memory expansion system is suited for increasing the resolution of a graphics display from a low-resolution to a high-resolution display. A video display device is adapted to receive a relatively simple graphics memory expansion accessory to thereby easily and inexpensively provide the increased graphics memory capability.

7 Claims, 5 Drawing Figures

GRAPHICS MEMORY EXPANSION SYSTEM

BACKGROUND OF THE INVENTION

1. Field of the Invention

The present invention relates to computer display devices that display graphics and more particulary to a system for expanding the available graphics memory. The invention is particularly suited for increasing the graphics resolution produced by computer display device.

2. Description of the Prior Art

Various computer display devices are well known which include a screen for displaying graphics. Such devices include raster scan devices wherein the display device screen displays a plurality of individually addressable picture elements (pixels) arranged in a matrix. Graphics memory within the display device includes one or more memory bits for each pixel with the visual representation of the pixel controlled by the state of the associated bit or bits. For example, where one bit per pixel is available, the state of the bit (that is, "on" (one) or "off" (zero) in a binary system) defines the visual representation of that particular pixel on the display device screen.

Generally, a dedicated graphics controller controls the visual representation shown by the display device screen. The graphics controller can be part of the display device or can be part of a computer system. For example, the graphics controller can be "plug-compatible" with the particular address, data and control buses of the computer system, in which case the graphics controller comprises one or more plug-in system cards. The graphics controller can include circuitry to control the timing necessary to synchronize the display device and the memory for the graphics display, thereby determining the maximum graphics display resolution.

It is often desirable to vary the resolution of the graphics display, that is, the number of pixels comprising the graphics matrix. This may occur where a low resolution graphics display is first purchased because of lower cost but which subsequentally becomes inadequate to meet the needs of the user. However, in order to provide graphics resolution greater than the maximum resolution available from the graphics memory of the controller, the controller must be replaced with a new controller having expanded graphics memory capabilities. Since the entire graphics controller must be replaced, the cost of increasing the graphics resolution is relatively great. This high cost consequently can discourage a graphics display user from upgrading the graphics resolution despite its desirability where, for example, complex graphic representations are to be displayed on the display device screen.

Thus, there is a need for a graphics display system wherein the resolution of the graphics display can be easily and inexpensively changed.

SUMMARY OF THE INVENTION

The present invention resides in a memory expansion system which overcomes the limitations and drawbacks set forth above. The invention enables the resolution of a graphics display to be easily varied, either from low-resolution graphics to high-resolution graphics or vice versa. Such a change can be accomplished by simply connecting or disconnecting a graphics memory expansion accessory without the use of special tools, training or test equipment.

Toward the foregoing ends, the present invention is embodied in a graphics memory system comprising a primary memory responsive to a first block of address codes. The primary memory stores data for pixels of a low-resolution graphics display. The primary memory also includes a graphics clock and a first counter for counting the graphics clock signal, the counter generating sequential address codes within the first block of address codes. A graphics memory expansion accessory is adapted to be connected to the primary memory, the accessory including additional graphics memory responsive to a second block of address codes sequentially related to the first block. The expansion graphics memory stores additional pixel data for providing a high-resolution graphics dispay with the primary memory. The graphics clock of the primary memory is responsive to the presence of the memory expansion accessory for altering the clock signal frequency to a second frequency such that a second counter which includes the first counter generates sequential address codes within the first and second blocks of address codes.

In a preferred embodiment, a parallel-to-serial shift register responsive to the stored data and to a clock signal converts the data into a serial signal that is used to form a composite video signal. The low-resolution graphics occupies the same overall pixel matrix as the high-resolution graphics with the primary memory providing memory for selected pixels within the pixel matrix. Accordingly, gating responsive to the absence of the memory expansion accessory inhibits counting by the first counter during predetermined time intervals corresponding to selected rows of pixels not used for low-resolution graphics and the frequency of the clock signal applied to the parallel-to-serial shift register is varied to generate fewer pixels per selected pixel row.

Figure 1:
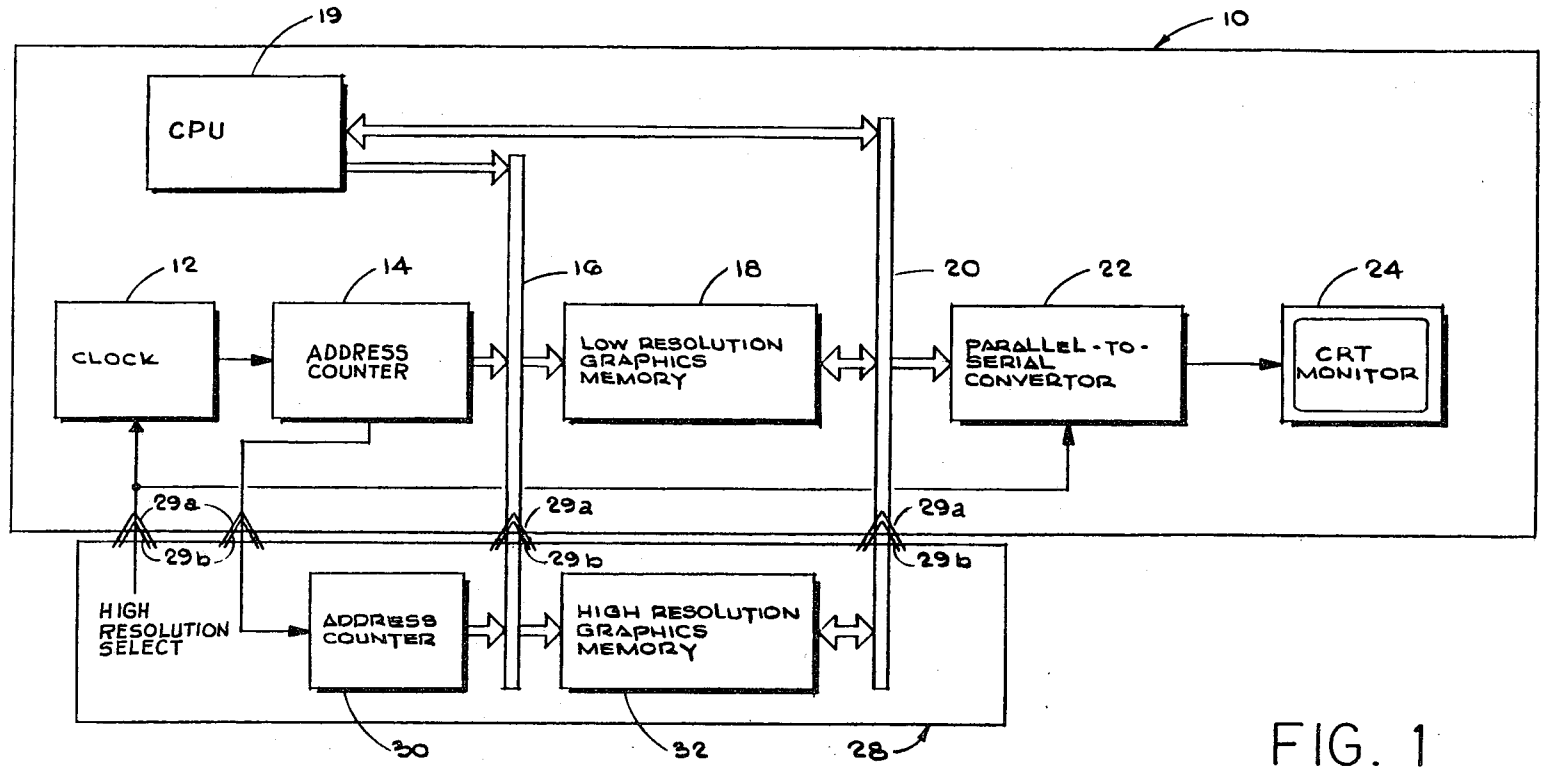
FIG. 1 is a simplified bock diagram of a display device incorporating a graphics memory expansion system in accordance with the present invention.
Figure 2A:
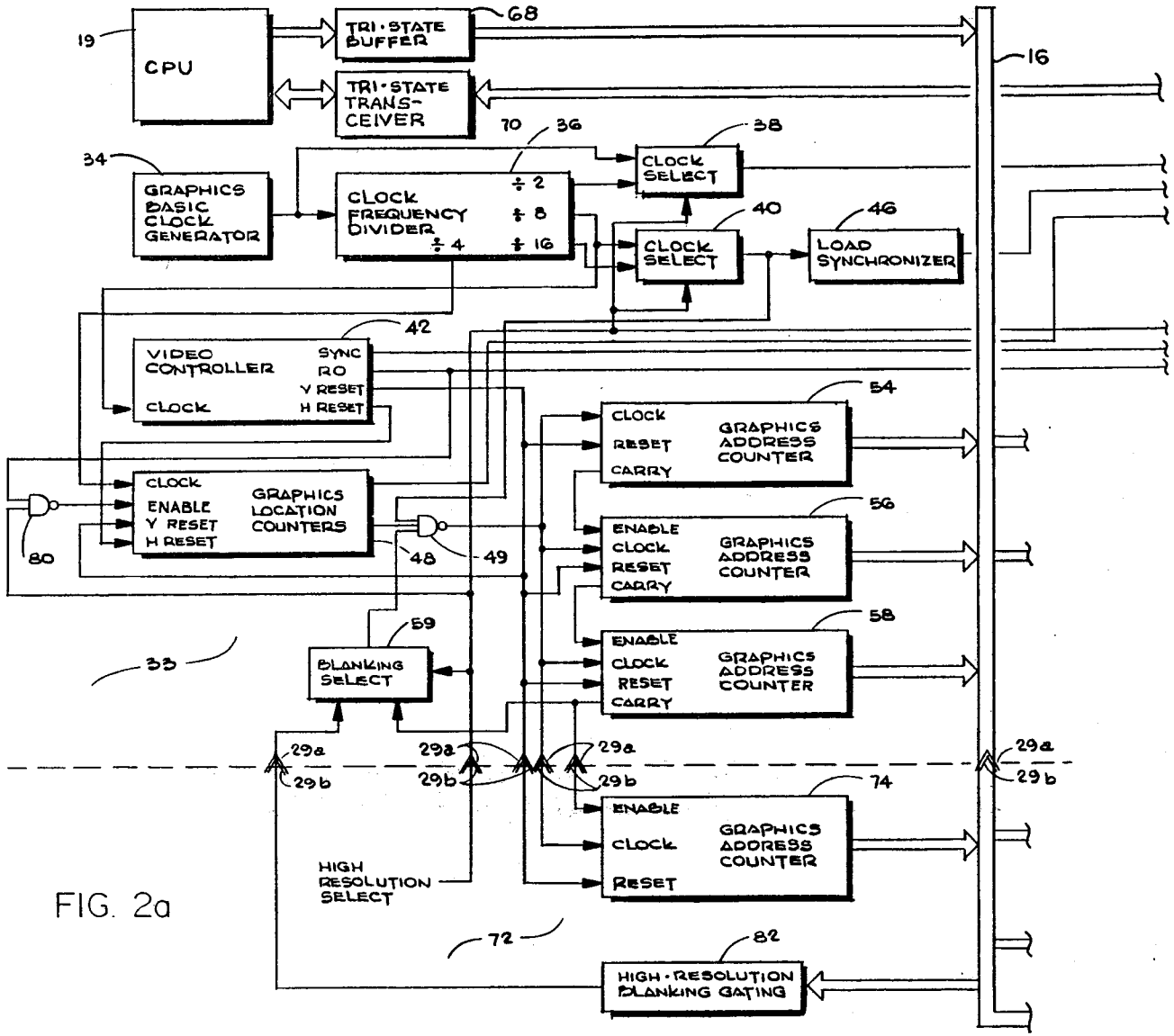
Figure 2B:
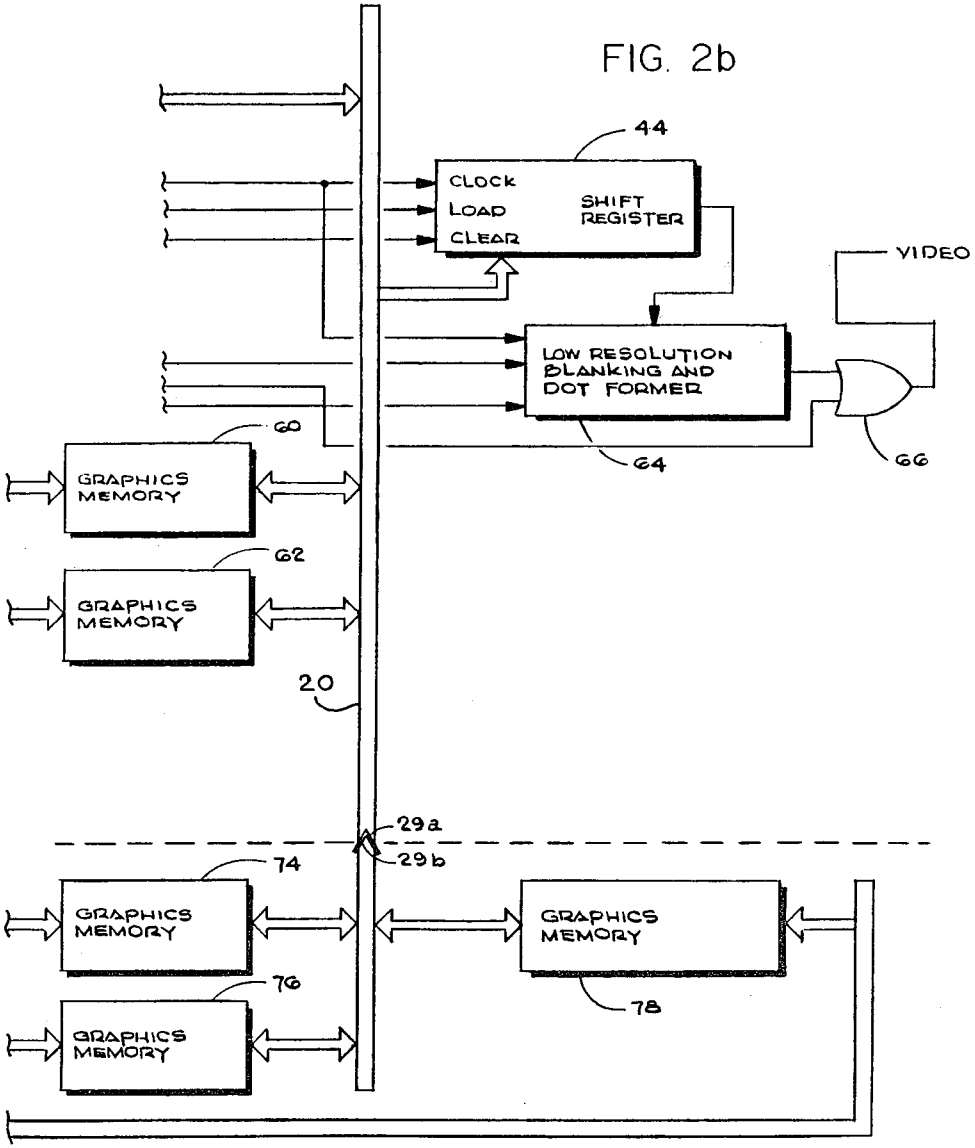

FIGS. *2a* and *2b* together comprise FIG. 2 which is a detailed block diagram of the memory expansion system of FIG. 1.

Figure 3:
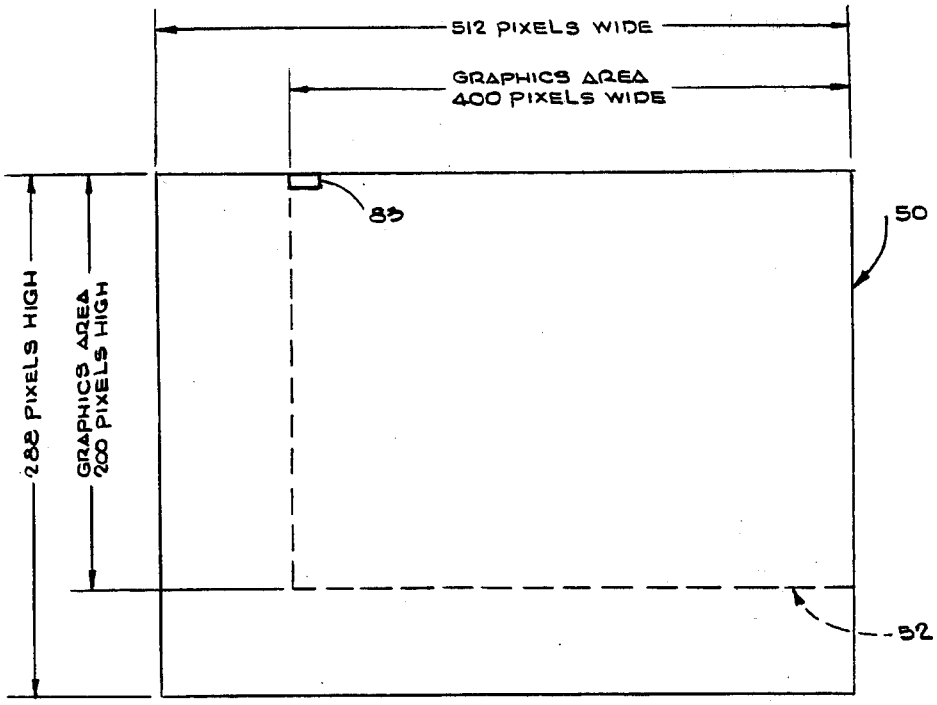

FIG. 3 is a diagram of a display area showing the pixel arrangement thereof.

Figure 4:
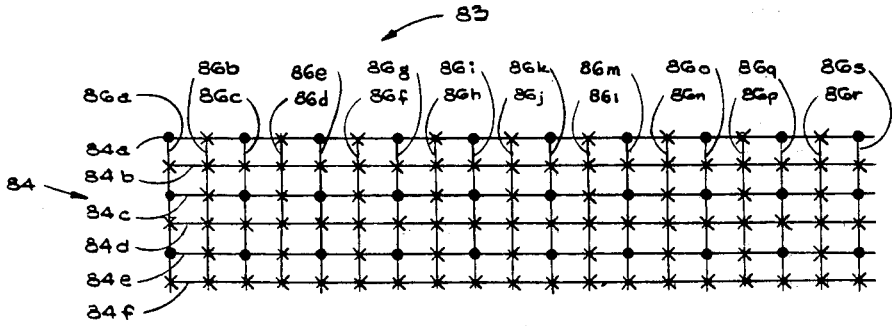

FIG. 4 is a diagram of a portion of the low-resolution and high-resolution pixels within the graphics area of FIG. 3.

DESCRIPTION OF THE PREFERRED EMBODIMENT

As seen with reference to FIG. 1, a display device 10 incorporates a memory expansion system in accordance with the present invention as is described in detail below with respect to FIG. 2. The device 10 includes a clock 12 generating clock pulses for an address counter 14. The address counter 14 generates signals corresponding to sequential address codes which are applied via an address bus 16 to a low-resolution graphics memory 18. The low-resolution graphics memory 18 stores eight bits of pixel data (one byte or word) for each address code generated by the address counter 14, each of the bits of pixel data corresponding to a predetermined pixel within a graphics display matrix. A central processing unit (CPU) 19 is in communication with the address bus 16 and a data bus 20 to thereby control the contents of the low-resolution graphics memory 18 in a conventional fashion.

Each eight bit word read from the memory 18 in response to the sequential address codes is communicated via the data bus 20 to a parallel-to-serial converter 22, described more fully hereinbelow with reference to FIG. 2. The converter 22 incorporates each byte of data into a composite video signal which is applied to a CRT monitor 24. The monitor 24 js a conventional raster scan device which displays successive horizontal lines. A plurality of sequentially addressed bytes from the low-resolution graphics memory 18 provide the pixel data for a selected horizontal line displayed by the CRT monitor 24. Successive groups of the bytes stored in the memory 18 correspond to successive selected horizontal lines appearing on the monitor 24.

The low-resolution display provided by the display device 10 comprises a graphics area within which only one quarter of the total pixels are enabled. More particularly, every other horizontal line in the graphics display is enabled to display low-resolution graphics pixels and, on those selected rows, only every other pixel is enabled.

To convert the display device 10 from low-resolution graphics to high-resolution graphics, the device 10 is adapted to receive a graphics memory expansion accessory 28. In the embodiment disclosed herein, the device 10 includes a plurality of contacts 29*a* that receive mating contacts 29*b* of the accessory 28. The contacts 29*a* and 29*b*, which can be mating portion of, for example, a multi-pin connector, provide connecting means for signals communicated between the device 10 and the accessory 28.

The accessory 28 includes an additional address counter 30 which is responsive to a carry signal from the address counter 14. The address counter 30 generates additional signals that are applied to the bus 16 to expand the number of address codes available. A high-resolution graphics memory 32 is responsive to the address codes on the bus 16 and stores a plurality of eight bit bytes of high-resolution pixel data for the additional pixels required to convert the low-resolution display to a high-resolution display. As with the data stored in the low resolution graphics memory 18, the CPU 19 controls the contents of the memory 32 in a conventional fashion.

The addresses of these high-resolution bytes of pixel data are in a second block of address codes which are sequentially related to the block of address codes for the low-resolution graphics memory 18. Each address code is a binary number generated by the address counter 14 for low-resolution graphics or by both address counters 14 and 30 for high-resolution graphics. Each such binary number is one greater than the binary number for the previous address code and is one less than the binary number for the next address code. Moreover, the binary number for the last address code in the first block of address codes is one less than the binary number for the first address codes in the second block of address codes. Thus, address codes within the first and second blocks of codes are sequentially related (increasing binary numbers). The first and second blocks of address codes are also sequentially related, that is, the low-resolution graphics memory 18 address codes are formed with lower binary numbers than the binary numbers forming the second block of address codes for the high resolution graphics memory 32. It is to be noted that the address counters 14 and 30 together generate an uninterrupted sequence of increasing binary numbers corresponding to address codes beginning with the start of the first block and ending with the end of the second block to thereby address the entire graphics memory comprising the low-resolution graphics memory 18 and the high-resolution graphics memory 32.

The display device 10 is responsive to the presence of the accessory 28 to vary several clock rates therein. More particularly and as is described more fully hereinbelow, a high-resolution select command is supplied from the accessory 28 to the clock 12 and the converter 22. This command increases the frequency of the clock 12 and increases the rate at which the converter 22 converts the parallel data from the bus 20 to the serial data required by the CRT monitor 24. For example, in the embodiment disclosed herein, the high-resolution graphics display provides twice the number of pixels per horizontal row or line displayed by the CRT monitor 24 and also provides a horizontal row or line of high-resolution pixels between each horizontal row or line of low-resolution pixels. Thus, the frequency of the clock 12 is doubled and the rate at which the converter 22 operates is also doubled. Additionally, the counters 14 and 30 are clocked during each horizontal line displayed by the CRT monitor 24.

Turning now to FIG. 2, the portion of FIG. 2 designated 33 corresponds generally to the graphics memory expansion elements included within the display device 10 of FIG. 1. Generally, these elements comprise the clock 12 (FIG. 1), the address counter 14, the low resolution graphics memory 18 and the parallel-to-serial converter 22.

Continuing with the description of FIG. 2, a graphics basic clock generator 34 provides the fundamental or basic clock frequency for the display device. In the preferred embodiment, a basic frequency of 11.419 MHz is utilized, although it will be recognized that this frequency can be varied in accordance with the requirements of the particular display device.

The clock signal generated by the generator 34 is applied to a clock frequency divider 36 which has a plurality of lower frequency outputs related to the frequency of the clock 34. The basic clock frequency and divide-by-two output from the divider 36 are applied to a first clock select 38 while divide-by-eight and divide-by-sixteen outputs from the divider 36 are applied to a second clock select 40. The first and second clock selects 38 and 40 can be of conventional design such as gating or other means to select as an output one of two inputs in response to a select command or input select signal. A divide-by-four output from the clock frequency divider 36 is connected to a clock input of graphics location counters 48. The divide-by-eight output is also connected to the clock input of a video controller 42. The video controller 42 generates various signals which are used by the CRT monitor 24 to generate, for example, alphanumeric characters and also to provide video synchronizing signals. In a preferred embodiment, the video controller 42 is a type 6845 such as that manufactured by Motorola, Inc., and as described in The Complete Motorola Microcomputer Data Library, copyright 1978, p. 1-159. This type video controller is also available from, for example, Hatachi, AMD and Synertec. The V reset (vertical interval reset) and H reset (horizontal interval reset) outputs from the video controller 42 are also applied to corresponding inputs of the graphics location counters 48.

The clock select 38 selects between the basic clock frequency from the generator 34 and the divide-by-two frequency from the divider 36 and provides the selected output to the clock input of a shift register 44. Similarly, the clock select 40 selects between the divide-by-eight and divide-by-sixteen signals to provide an output to a load synchronizer 46 and to one input of a NAND gate 49. The load synchronizer 46 employs conventional gating to generate a load pulse output or signal which is delayed from the clock signal at the output of the clock select 40. This delay allows the clock signal to propagate through the remainder of the circuitry as described below which generates data that is loaded into the shift register 44. The delay ensures that the data is stable before the shift register 44 is loaded. The load synchronizer 46 can comprise, for example, a NAND gate (not shown) responsive to the output of the clock select 40 and also responsive to various clock signals (for example, divide-by-two, divide-by-four and divide-by-eight) from the clock frequency divider 36. The phases of the combined clock signals produce the load signal from the NAND gate delayed as just described. It is to be recognized that other suitable means for generating the load signal may be employed.

As seen with reference to FIG. 3, the exemplary embodiment disclosed herein provides a display area 50 comprising a matrix 512 pixels wide by 288 pixels high. The pixels within the display area 50 can be used, for example, to display alphanumeric dot matrix characters as is well known in the art. Within the overall display area 50, a graphics area 52 is defined by a matrix 400 pixels wide by 200 pixels high. The graphics area 52 accordingly comprises a sub-set of the pixels comprising the display area 50.

The graphics location counters 48 can comprise one or more conventional counters which are presettable to a particular starting count. When enabled by an enable input described below, the counters 48 count the divide-by-four output clock pulses from the clock frequency divider 36. Once the counters 48 count enough of the clock pulses to reach a predetermined output state, the counters 48 generate an output that is applied to the gate 49. The graphics location counters 48 also generate a clear signal until the output to the gate 49 is generated. This clear signal is applied to a clear input of the shift register 44 to clear the register 44 until the gate 49 is enabled. The counters 48 are reset to the starting count by the V reset or H reset signals from the video controller 42.

By varying the starting count, the number of clock pulses counted by lhe counters 48 is also varied, thus changing the length of time required to remove the clear signal from the shift register 44 and generate the output to the gate 49. As is described more fully hereinbelow, this produces a delay in clock pulses from the gate 49 and thus delays the start of the graphics area 52. By means of such a delay, the graphics location counters 48 thereby position the graphics area 52 within the overall display area 50. Once the delay is completed, the clear signal is removed from the shift register 44 and the clock signals from the clock select 40 are applied through the gate 49 to the clock inputs of graphics address counters 54, 56 and 58.

The signal from the V reset output of the video controller 42 is communicated to reset inputs of the counters 54, 56 and 58. The counters 54 and 56 generate carry signals which are applied to the enable inputs of the next counters 56 and 58, respectively, thereby cascading the counters 54, 56 and 58 in a conventional fashion. The carry output from the counter 58 is applied to a blanking select 59. The blanking select comprises conventional logic and is also responsive to a high resolution select signal and a high-resolution blanking signal as is described hereinbelow. The blanking select 59 selects between the counter 58 carry output and the high-resolution blanking signal according to the high-resolution select signal and applies the selected signal to the gate 49.

The outputs from the counters 54, 56 and 58 are signals representative of a binary number which corresponds to an address code. As the counters 54, 56 and 58 are clocked, the binary number is incremented by one to form the next sequential address code. In this way, the counters 54, 56 and 58 generate sequential address codes which are applied to the address bus 16. The address bus 16 communicates these sequential address codes to two graphics memories 60 and 62 which together comprise the low-resolution graphics memory 18 of FIG. 1.

The graphics memories 60 and 62 are conventional random access memory (RAM) devices which each store 2,048 eiqht-bit bytes of pixel data, each bit corresponding to a particular pixel within the graphics area 52. The pixel data is generated by the CPU 19 and is written into the graphics memories 60 and 62 in a conventional fashion. The memories 60 and 62 respond to the sequential address codes generated by the counters 54, 56 and 58 and generate corresponding bytes of pixel data (one byte of pixel data for each address code) which are applied to the data bus 20. More particularly, the memories 60 and 62 are arranged for sequential addressing, that is, the contents of the memory 60 are accessed first and the contents of the memory 62 are accessed second as the address codes sequentially increase. The particular address code determines whether the graphics memory 60 or the graphics memory 62 generates the corresponding byte of pixel data. The data bus 20 in turn applies these bytes to the shift register 44. The bytes of parallel data are loaded into the shift register 44 in response to the load signal from the load synchronizer 46. As described above, the synchronizer 46 allows the outputs from the memory 60 or 62 to become stable before the data is loaded into the shift register 44.

The shift register 44 converts the parallel bytes of pixel data into a serial stream or train of bits that are applied to a low-resolution blanking and dot former 64. The signal from the clock select 38 and a signal from a RO (row zero) output of the video controller 42 are applied to the low resolution blanking and dot former 64. The low resolution blanking and dot former 64 can be a conventional array of logic elements such as ates which gate the output from the shift register 44 to form low-resolution dots in response to the signal from the clock select 38 and to blank the shift register output completely during selected rows of the graphics area 52 in response to the RO output. The low resolution blanking and dot former 64 is also responsive to a high resolution select signal to disable its operation and consequently not alter the output of the shift register 44. The resulting serial signal from the low-resolution blanking and dot former 64 is applied to an OR gate 66 along with vertical and horizontal synchronizing signals from a sync output of the video controller 42. The gate 66 combines these signals to produce a composite video output which can be applied to the CRT monitor 24 as seen in FIG. 1. It is to be recognized that the signals combined by the gate 66 can instead be applied separately to the monitor 24 if the monitor 24 is adapted to accept such uncombined signals. Such uncombined signals are particularly useful where the frequency response of the monitor 24 prevents use of a composite video signal as generated by the gate 66.

The CPU 19 communicates through a tri-state buffer 68 with the address bus 16 and through a tri-state transceiver 70 with the data bus 20. The CPU 19 is a microprocessor-based system of conventional design including a microprocessor, read-only memory (ROM), and random access memory (RAM). In the embodiment disclosed herein, the microprocessor can be a type 8088 manufactured by Intel, Inc., although other microprocessors adapted for use with the Intel "Multibus" system can be used. The CPU 19 employs components from the family of devices designed to operate with and complement the 8088. The tri-state buffer 68 is a conventional device that has outputs that are three-state or tri-state as is known in the art. The first two states correspond to binary zero or one while the third state is a high-impedance state which allows other devices (the graphics address counters 54, 56 and 58 in the embodiment of FIG. 2) to apply address signals to the address bus 16. It is to be noted that the graphics address counters 54, 56 and 58 also have tri-state outputs to allow the CPU to control the address bus 16. The tri-state transceiver 70 is also a tri-state device that allows bi-directional data transfer between the CPU 19 and the graphics memories 60 and 62. The CPU 19 communicates with the graphics memories 60 and 62 to vary the data stored in the graphics memories 60 and 62 to thereby control the state of the bits stored therein and thus the visual representation of the pixels displayed by the CRT monitor 24. Any conventional source of graphics may be used by the CPU 19 for writing graphics into the graphics memories 60 and 62. For example, the graphics can result from plotting various numerical data. Routines and algorithms for plotting lines into a matrix of pixels and other shapes are well known and will not be explained in detail here.

To expand the graphics display from low resolution to high resolution, the graphics memory expansion accessory 28 is connected through the contacts **29*a* and 29*b* to the display device 10. The accessory 28 generally comprises the portion of FIG. 2 designated 72**.

The output from the gate 49, the V reset output of the video controller 42 and the carry output from the graphics address counter 58 are applied to clock, reset and enable inputs of a fourth graphics address counter 74 which is similar to the graphics address counters 54, 56 and 58. The counter 74 expands the counting range of the counters 54, 56 and 58 to include the first and second blocks of address codes. Toward this end, the counter 74 applies additional signals to the bus 16 which increases the range of binary numbers represented by the signals and thus the number of address codes available. The address bus 16 also communicates with graphics memories 74, 76 and 78 which is similar to the memories 60 and 62. The memories 74, 76 and 78 each can store 2,048 eight-bit bytes of pixel data and together generally comprise the high-resolution graphics memory 32 of FIG. 1. The memories 74, 76 and 78 are in turn in bi-directional communication with the data bus 20.

A high-resolution select signal is applied from the accessory circuitry to the first and second clock selects 38 and 40, to the blanking select 59, to a NAND gate 80 and to the low resolution blanking and dot former 64. The other input of the gate 80 is connected to the RO output from the video controller 42 and the output of the gate 80 is applied to the enable input of the graphics location counters 48. The high resolution select signal can be generated in any conventional fashion as by, for example, connecting a normally high-level logic signal in the device 10 to ground potential within the portion 72 of the accessory 28, or vice versa. Moreover, the high resolution select signal can comprise a plurality of individual signals in the device 10 each varied by the presence of the accessory 28. It will also be apparent that the high resolution select signal can be generated by a switch mechanically operated when the accessory 28 is connected to the device 10. Those skilled in the art will recoqnize other suitable variations and alternatives.

The address bus 16 is also applied to high-resolution blanking gating 82. The gating 82 uses conventional logic elements to generate a high resolution blanking signal when the address codes on the bus 16 reach the end of the available memory above the upper limit of the second block of address codes used in the high resolution mode of operation. The high-resolution blanking signal is applied through contacts **29*a* and 29*b* to the blanking select 59**.

The operation of the high-resolution graphics expansion system will now be considered.

First, it is assumed that the portion 72 of FIG. 2 is disconnected from the portion 33 thereof. In this configuration the display device 10 provides a low-resolution graphics display within the graphics area 52. As seen with reference to FIG. 4, pixels which are enabled in the low-resolution mode of operation are indicated by solid dots. The pixels illustrated in FIG. 4 are an enlargement of an upper left-hand portion 83 of the graphics area 52. The area 82 comprises a plurality of pixel rows 84 individually designated **84*a*, 84*b*, 84*c*, 84*d*, 84*e* and 84*f*, and pixel columns 86 designated individually 86*a* through 86*s***.

In the low-resolution mode, it is seen that one-quarter of the available pixels are enabled. That is, pixels only on every other row **84*a*, 84*c* and 84*e* are enabled. Moreover, only every other pixel within the enabled rows are enabled, that is, the pixels on columns 86*a*, 86*c*, 86*e* and so on. Thus, within the graphics area defined in FIG. 3, a total of 20,000 pixels are enabled in the low-resolution mode, the pixels being evenly distributed throughout the graphics area 52**.

In the absence of the high resolution select signal, the clock select 38 (FIG. 2) and clock select 40 select as outputs the lower of the two frequency signals applied thereto. That is, clock select 38 selects the divide-by-two output from the divider 36 while the clock select 40 selects the divide-by-sixteen output from the divider 36.

A low-resolution graphics display cycle begins with the video controller 42 generating vertical and horizontal interval reset signals (V reset and H reset). The V reset signal resets the graphics address counters 54, 56 and 58 to the first address code within the block of address codes to which the graphics memories 60 and 62 respond. The V reset and H reset signals also reset the graphics location counters 48. These location counters are preset to the predetermined starting count according to the position of the graphics area 52 within the overall display area 50.

During the display of low-resolution graphics, the gate 80 is enabled by the absence of the high resolution select signal to control the counters 48 via the enable input to the counters 48. The RO output from the video controller 42 is the least significant bit of a binary representation of the video display horizontal line or row presently being generated by the ate 66. As such, the RO output changes state with each successive horizontal row within the display area 50. For example, the state of the RO output for the first row 84*a* is a logic zero, a logic one for row 84*b*, a logic zero for row 84*c*, and so on. With the RO output at a logic zero, the counters 48 are enabled by the gate 80. However, a logic level of one at the RO output disables the counters 48. Consequently, the counters 48 operate only during every other horizontal row of the display area 50.

When enabled, the counters 8 count the clock from the divide-by-four output of the divider 36. In an exemplary embodiment, the predetermined starting count controls the graphics location counters 48 which generate an output to the gate 49 corresponding to a delay of 112 pixels from the resets (V reset or H reset) produced by the video controller 42. During the delay period, the shift register 44 is cleared by the clear signal from the counters 48. As seen in FIG. 3, this begins the graphics area at the 113th pixel from the left edge of the display area 50. It is to be understood that, while the graphics location counters 48 advantageously provide control of the placement of the graphics area within the display area 50, such counters 48 are not necessary to the implementation of the present invention. For example, where the graphics area 52 corresponds to the overall display area 50, no delay is necessary to position the graphics area 52. Consequently, the output of the gate 80 can be connected directly to the input of the gate 49 shown in FIG. 2 to be connected to the graphics location counters 48.

Once the output from the graphics location counters 48 is received by the gate 49, the gate 49 applies the clock from the clock select 40 to the graphics address counters 54, 56 and 58. These counters generate the sequential binary address codes applied to the graphics memories 60 and 62. The binary number corresponding to the signals generated by the counters 54, 56 and 58 is sequentially incremented by one with each clock pulse applied to the counters 54, 56 and 58 to thereby sequentially address the graphics memories 60 and 62 through the first block of address codes.

For each such address code, one of the memories 60 or 62 applies an eight-bit pixel data byte to the data bus 20. Each byte is in turn loaded into the shift register 44 in response to the signal from the load synchronizer 46. The clock pulses from the clock select 38 then control the shift register 44 to serially shift the eight-bit byte out of the shift register 44 one bit per clock cycle. In the low-resolution mode, each clock cycle from the clock select 38 corresponds in time to two pixels on a line in the graphics area 52. For example, the first address code generated by the graphics address counters 54, 56 and 58 addresses the first byte of low-resolution graphics memory which is stored in the graphics memory 60. This first byte corresponds to the first eight low-resolution pixels to be displayed. As seen in FIG. 4, these first pixels are on the line 84*a* and appear at the columns 86*a*, 86*c*, 86*e*, 86*g*, 86*i*, 86*k*, 86*m* and 86*o*. This pixel data byte is in turn loaded into the shift register 44.

As described previously, the bits forming the pixel data byte are individually shifted out of the shift register 44 and are applied to the low-resolution blanking and dot former 64. Because the clock cycle from the clock select 38 in the low-resolution mode corresponds in time to two pixels on the row 84*a*, the clock signal from the clock select 38 is also applied to the low-resolution blanking and dot former 64 to blank the output from the shift register 44 during the second portion of the clock cycle from the clock select 38. As described previously, this can be accomplished with conventional gating such as an AND gate combining the shift register output and the clock signal. Thus, the pixel data byte loaded into shift register 44 is converted into an output from the low-resolution blanking and dot former 64 to provide the first eight low-resolution pixels on the line 84*a* (FIG. 4).

Once the first byte of pixel data from the graphics memory 60 has been loaded into the shift register 44, the next clock pulse from the clock select 40 increments the graphics address counters 54, 56 and 58 by one to the next sequential address code within the first block of the address codes. The graphics memory 60 in response to this address code, generates a second pixel data byte corresponding to the next eight low-resolution pixels on the line 84*a*. These pixels are similarly converted by the shift register 44 and the low-resolution blanking and dot former 64 into the next group of eight low-resolution pixels on the line 84*a* beginning with the pixel at column 86*q*. This process is repeated for the remainder of the line 84*a*, requiring a total of twenty-five pixel data bytes from the graphics memories 60 and 62. The output from the low resolution blanking and dot former 64 is combined with synchronizing signals from the video controller 42 at the gate 66 to provide conventional composite video to the CRT monitor 24 (FIG. 1).

At the completion of the line 84*a*, the video controller 42 then provides an RO output signal indicating that the next line, line 84*b*, is being generated. This signal controls the low-resolution blanking and dot former 64 to blank any output from the shift register 44 to thereby prevent the display of any pixels on the line 84*b* as required in the low resolution graphics mode. As described previously, this can be accomplished in a known fashion by combining the RO output signal with the shift register 44 output such as with an AND gate. Additionally, the RO output disables the graphics location counters 48 by means of the gate 80, thus preventing further clock pulses from being applied through the gate 49 to the graphics address counters 54, 56 and 58 while row 84*b* is scanned by the monitor 24.

At the completion of line 84*b*, the video controller 42 again changes the state of the RO output, enabling the graphics location counters 48 via the gate 80 and the low-resolution blanking and dot former 64. The horizontal reset signal (H reset) from the video controller 42 resets the graphics location counters 48 to again provide the horizontal delay described above. At the end of this delay, the clear signal is removed from the shift register 44 and the output from the counters 48 enables the gate 49 to apply clock pulses to the address counters 54, 56 and 58 which continue to sequentially address the graphics memories 60 and 62. The shift register 44 and the low-resolution blanking and dot former 64 then operate as previously described to generate the serial output comprising the low-resolution pixels. It is to be noted that the byte corresponding to the first eight low-resolution pixels on line 84*c* has an address code that sequentially follows the address code for the byte corresponding to the last eight low-resolution pixels on line 84*a*. This allows the graphics address counters 54, 56 and 58 to simply count the clock pulses applied thereto to thus generate the sequential address codes for the low-resolution graphics display. This sequential arrangement is repeated throughout the block of address codes allocated for low-resolution graphics.

Once each of the bytes stored by the graphics memories 60 and 62 have been accessed in this way, the carry signal from the graphics address counter 58 is applied through blanking select 59 and disables the gate 49 until the counters 54, 56 and 58 are reset by the V reset signal from the video controller 42. This completes the low-resolution graphics display cycle. For each low-resolution graphics display cycle, the graphics address counters 54, 56 and 58 are incremented through 4,096 sequential address codes. However, only 2,500 bytes or memory locations are used within the graphics memories 60 and 62 for the low-resolution graphics and thus only these 2,500 bytes contain pixel data. Consequently, the first block of address codes comprises the sequential address codes necessary to address 2,500 bytes within the graphics memories 60 and 62. These 2,500 can comprise the entire capacity of the graphics memory 60 (2,048 bytes storing the first 2,048 bytes of pixel data) and an additional 452 bytes of memory of the graphics memory 62 and corresponding to the remaining 452 bytes of pixel data. The remaining bytes of the graphics memory 62 are not used in the low-resolution graphics mode of operation but are used to display high-resolution graphics as will be described subsequently.

The low-resolution graphics display cycle is repeated at, for example, sixty times per second to provide a substantially continuous display on the CRT monitor 24.

By connecting the accessory 28 to the display device 10, the low-resolution graphics display produced by the display device 10 as described above is advantageously converted to a high-resolution graphics display.

The high-resolution select signal from the accessory 28 (portion 72 of FIG. 2) controls the clock selects 38 and 40 to provide the basic clock frequency from the clock generator 34 to the shift register 44 and to apply the divide-by-eight signal from the divider 36 to the gate 49. The high-resolution select signal continuously enables the graphics location counters 48 as controlled by the gate 80, disables the low resolution blanking and dot former 64 such that it passes the shift register 44 output unaltered, and controls the logic of the blanking select 59 to apply the blanking signal from the high resolution blanking gating 82 to the gate 49.

The high-resolution graphics display is begun as described above with the video controller 42 generating vertical and horizontal reset (V reset and H reset) signals. After the delay established by the graphics location counters 48, the gate 49 applies the divide-by-eight clock signal to the graphics address counters 54, 56 and 58 along with the accessory graphics address counter 74. These counters are thus operated at a second higher frequency and, in the exemplary embodiment, at a frequency twice that employed in the low-resolution mode. These counters consequently generate sequential address codes within the first block of address codes and then continue to count to thereby generate address codes within the second block of address codes sequentially related to the first block. The second block of address codes addresses an additional 7,500 bytes of graphics memory which can comprise the remaining bytes within the graphics memory 62 and 5,904 bytes of memory within graphics memories 74, 76 and 78. It is to be noted that the graphics memories 74, 76 and 78 store a total of 6,144 bytes but only 5,904 bytes of this total capacity is used. As explained hereinbefore, the last address code in the first block sequentially precedes the first address code in the second block thus easily and efficiently combining the blocks of address codes and simplifying the interface between the address counters and graphics memories within the device 10 and the accessory 28, corresponding to portions 33 and 72 of FIG. 2, respectively.

For high-resolution graphics, all pixels within the graphics area 52 (FIGS. 3 and 4) are used. That is, pixels identified by dots (original low-resolution pixels) and pixels identified by X's (supplemental high-resolution pixels) are enabled to provide high-resolution graphics having four times the pixels enabled in the low-resolution mode. In the high-resolution graphics mode, the first pixel data byte stored by the graphics memory 60 corresponds to the eight pixels on line **84*a* at columns 86*a*–86*h*. It is to be remembered that this first pixel data byte was used in the low-resolution mode to form the first eight low-resolution pixels. This byte is loaded into the shift register 44 and is shifted out at the basic clock frequency, that is, at twice the frequency used in the low-resolution mode. Moreover, high-resolution pixels are displayed on each line of the graphics area, that is, lines 84*a*, 84*b*, and so on. Consequently, the low-resolution blanking and dot former 64 is inactive during high-resolution graphics display and passes the output from the shift register 44 directly to the gate 66. Also, since all lines 84 within the graphics area 52 are enabled, the graphics location counters 48 are continuously enabled by the gate 80 to control the gate 49, applying clock pulses to the counters 54, 56, 58 and 74 for each of the lines 84, rather than alternate lines as described previously for the low-resolution mode. These clock pulses are gated to the counters 54, 56, 58 and 74 after the delay produced by the graphics location counters 48** as described previously.

Once all 10,000 bytes of high resolution graphics memory bytes have been accessed (2,500 in the first address code bock and 7,500 in the second address code block) the counters 54, 56, 58 and 74 continue to count until a total of 10,240 bytes of memory have been accessed. The remaining 240 bytes of memory are not used in the high-resolution mode. The gating 82 then generates the high-resolution blanking signal that is applied through the blanking select 59 to disable the gate 49 until the counters 54, 56, 58 and 74 are reset by the video controller 42, again beginning the high resolution graphics cycle. As with the low-resolution graphics mode, the cycle is repeated sixty times per second to provide the graphics display.

It will be recognized by those skilled in the art that although the accessory 28 has been described herein as including the graphics address counter 74 (30 in FIG. 1) which expands the range of the counters 54, 56 and 58 sufficiently to generate address codes in both the first and second groups, the graphics address counter 74 could instead be a part of the display device 10. Alternately, the counters 54, 56 and 58 (14 in FIG. 1) could be selected or designed to provide the required counting range necessary to cover the first and second groups of address codes.

Thus, it is seen that the graphics memory expansion system in accordance with the present invention easily and quickly allows expansion from low-resolution graphics to high-resolution graphics. The change does not require replacement of an entire graphics controller but only the addition of a relatively simple accessory to the display device.

In the exemplary embodiment, the low-resolution graphics display occupies the same graphics area as the high-resolution display by varying the row and column spacings between adjacent pixels.

While a preferred embodiment of the invention has been illustrated and described, it will be understood that various modifications may be made therein without departing from the spirit and scope of the appended claims.

What is claimed is:

1. A memory expansion system for a display apparatus wherein the display apparatus includes display means for displaying a plurality of picture elements arranged in a matrix, the system comprising:

a primary memory including primary memory means responsive to a first block of address codes for storing data at each address of the first block of address codes, the data corresponding at least to a portion of the picture elements of the display means, clock means for generating a clock signal having a first predetermined clock frequency, and first counter means for counting the clock signal to generate sequential address codes within the first block of address codes;

a memory expansion accessory adapted to be connected to the primary memory including expansion memory means responsive to a second block of address codes sequentially related to the first block of address codes for storing data at each address of the second block of address codes, the data corresponding at least in part to a second portion of the picture elements of the display means;

means for generating an expansion signal indicating that the memory expansion accessory is connected to the primary memory;

means responsive to the expansion signal for altering the clock signal frequency to a second predetermined frequency; and second counter means including the first counter means and responsive to the altered clock signal for generating the first and second block of address codes.

2. A memory expansion system as in claim 1 wherein the means responsive to the expansion signal includes means for altering the second frequency to be higher than the first frequency.

3. The invention of claim 1 wherein the matrix includes a plurality of rows of picture elements sequentially scanned by the display device, the primary memory including gating means for passing the clock means signals to the first counter means while the display means scans selected ones of the rows, the gating means being responsive to the expansion signal for passing the clock means signal to the second counter means while the display means scans each row of the picture elements.

4. A memory expansion system as in claim 1 wherein the memory expansion means includes third counter means and the second counter means includes the third counter means.

5. A memory expansion system for a display apparatus wherein the display apparatus includes display means for displaying a plurality of picture elements arranged in a matrix, the matrix including a plurality of rows of picture elements that are sequentially scanned by the display means, the system comprising:

a primary memory including primary memory means responsive to a first block of address codes for storing data at each address of the first block of address codes, the data corresponding at least to a portion of the picture elements of the display means, clock means for generating a clock signal having a first predetermined clock frequency;

gating means for controllably passing the clock signal, and, first counter means counting the clock signal from the gating means for generating the first block of address codes;

a memory expansion accessory adapted to be connected to the primary memory including expansion memory means responsive to a second block of address codes sequentially related to the first block of address codes for storing data at each address of the second block, the data corresponding at least in part to a second portion of the picture elements of the display means;

means for generating an expansion signal indicating that the memory expansion accessory is connected to the primary memory;

means responsive to the expansion signal for altering the clock signal frequency to a second predetermined frequency;

second counter means including the first counter means and responsive to the altered clock signal for generating the first and second blocks of address codes; and the gating means passing the clock means signal to the first counter means while the display means scans selected ones of the rows, and being responsive to the expansion signal for passing the clock signal to the second counter means while the display means scans each row of the picture elements.

6. A memory expansion system as in claim 5 wherein the system includes second clock means responsive to the expansion signal for generating a second clock signal having a frequency determined by the expansion signal; and shift register means responsive to the second clock signal and responsive to the data stored in the primary memory means or responsive to the data stored in primary memory means and the expansion memory means for converting the data stored in the primary memory means or the data stored in the primary memory means and the expansion memory means into a serial signal at a rate determined by the second clock signal.

7. A graphics display apparatus adapted to provide a graphics display in a first low-resolution display mode and a second high-resolution display mode, wherein the display apparatus includes display means for displaying a plurality of picture elements arranged in a matrix, the matrix including a plurality of rows of picture elements that are sequentially scanned by the display means, the system comprising:

a primary memory including primary memory means responsive to a first block of address codes for storing data at each address of the first block of address codes, the data corresponding to at least a portion of the picture elements, clock means for generating a clock signal having a first or a second predetermined clock frequency, means responsive to an expansion signal for altering the clock signal from the first predetermined frequency to the second predetermined frequency, gating means for controllably passing the clock signal, and first counter mean for counting the clock signal from the gating means to generate sequential address codes, the gating means passing the clock means signals to the first counter means while the dispay means scans the selected rows in the first display mode and responsive to the expansion signal for passing the clock means signal while the display means scans each row of picture elements in the second display mode, a memory expansion accessory adapted to be connected to the primary memory including expansion memory means responsive to a second block of address codes sequentially related to the first block of address codes for storing data at each address of the second block of address codes, the data corresponding at least in part to a second portion of picture elements of the display means, second counter means adapted to operate with the first counter means when the clock signal is altered to the second predetermined frequency, the first and second counter means together generating the first and second blocks of address codes, and means for generating the expansion signal indicating that a memory expansion accessory is connected to the primary memory.

* * * * *